US007992713B1

(12) United States Patent
Nelson et al.

(10) Patent No.: US 7,992,713 B1
(45) Date of Patent: Aug. 9, 2011

(54) DISK DRIVE PACKAGE

(75) Inventors: Laura E. Nelson, Hudson, MA (US); Richard Connelly, Pepperell, MA (US); Alyssa Caddle, South Boston, MA (US); Vincent Crean, Cross Waterfall (IR); Jeffrey Mingels, Westwood, MA (US); Paul Palombo, Mendon, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 12/979,402

(22) Filed: Dec. 28, 2010

(51) Int. Cl.
*B65D 85/30* (2006.01)
*B65D 81/02* (2006.01)

(52) U.S. Cl. ..... 206/522; 206/585; 206/594

(58) Field of Classification Search ..... 206/701, 206/722, 723, 724, 522, 585, 587, 591, 592, 206/594
See application file for complete search history.

(56) References Cited

U.S. PATENT DOCUMENTS

| | | | | |
|---|---|---|---|---|
| 4,713,248 | A * | 12/1987 | Kjornaes et al. | 424/468 |
| 5,996,798 | A * | 12/1999 | Gessert | 206/521 |
| 6,076,677 | A * | 6/2000 | Pozzo | 206/522 |
| 6,588,595 | B2 * | 7/2003 | Levin et al. | 206/589 |
| 7,383,953 | B2 * | 6/2008 | Dickinson | 206/522 |
| 7,584,851 | B2 * | 9/2009 | Hong et al. | 206/589 |
| 2002/0104776 | A1 * | 8/2002 | Foster | 206/594 |
| 2003/0052786 | A1 * | 3/2003 | Dickinson | 340/572.8 |
| 2003/0108705 | A1 * | 6/2003 | Duffield et al. | 428/36.6 |
| 2003/0205498 | A1 * | 11/2003 | Maresh et al. | 206/592 |
| 2005/0061704 | A1 * | 3/2005 | Cole et al. | 206/524.7 |
| 2005/0103963 | A1 * | 5/2005 | Bontrager et al. | 248/345.1 |
| 2005/0189257 | A1 | 9/2005 | Chen et al. | |
| 2007/0267317 | A1 * | 11/2007 | Van Der Schaaf et al. | 206/524.7 |
| 2008/0107362 | A1 | 5/2008 | Yoshifusa | |
| 2008/0314783 | A1 | 12/2008 | Yoshifusa | |
| 2009/0050510 | A1 * | 2/2009 | Kojima et al. | 206/522 |
| 2009/0078601 | A1 * | 3/2009 | Lin et al. | 206/307 |
| 2009/0123679 | A1 * | 5/2009 | Denome et al. | 428/35.2 |
| 2009/0242450 | A1 | 10/2009 | Zhang et al. | |

* cited by examiner

*Primary Examiner* — Jacob K Ackun

(57) ABSTRACT

A package for a disk drive includes: an outer corrugated carton having: sidewall; a bottom attached to the sidewalls; and, and a cover pivotally attached to pivot about one of the sidewalls; a pair of frame members, each one having four sidewalls affixed to a corresponding one of the cover and the bottom disposed about a receiving region of the frame members; an air-filled bubble-like packing device having check valves incorporated therein for providing a plurality of air filled chamber, such chambers being arranged to provide a shock absorbing pocket; and a container for receiving therein the disk drive. The plastic container with the disk rive therein are disposed within the pocket of the air-filled bubble-like packing device. The air-filled bubble-like packing device with the container therein and with the disk drive therein are disposed within the carton with portions of the air-filled bubble-like packing device being engaged by the frame members and other portions being disposed within the receiving region after the top is pivoted towards, and then attached to, the one of the sidewalls of the carton.

4 Claims, 9 Drawing Sheets

DISK DRIVE PACKAGE

TECHNICAL FIELD

This invention relates generally to packages and more particularly to packages for disk drives.

BACKGROUND

As is known in the art, small, relatively inexpensive packages are desirable for shipping disk drives from one place to another. In one type of packaging, vacuum formed plastic cushions and a doublewall container are used. However, such design is relatively large and expensive having relatively high material cost.

SUMMARY

In accordance with the disclosure, a package is provided for a disk drive. The package includes: an outer corrugated cardboard carton having: sidewall; a bottom attached to the sidewalls; and, a cover pivotally attached to pivot about one of the sidewalls; a pair of frame members, each one having four sidewalls affixed to a corresponding one of the cover and the bottom disposed about a receiving region of the frame members; an air-filled bubble-like packing device having check valves incorporated therein for providing a plurality of air filled chamber, such chambers being arranged to provide a shock absorbing pocket; and a container for receiving therein the disk drive. The plastic container with the disk rive therein are disposed within the pocket of the air-filled bubble-like packing device. The air-filled bubble-like packing device with the container therein and with the disk drive therein are disposed within the carton with portions of the air-filled bubble-like packing device being engaged by the frame members and other portions being disposed within the receiving region after the top is pivoted towards, and then attached to, the one of the sidewalls of the carton.

In one embodiment, the receiving region is oval-shaped having and the pocket is oval-shaped.

In one embodiment, the oval-shaped receiving region and the oval-shaped pocket are both elongated along the same direction.

In one embodiment, the chambers are elongated along a direction perpendicular to the elongated direction of the oval-shaped receiving region and the oval-shaped pocket.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
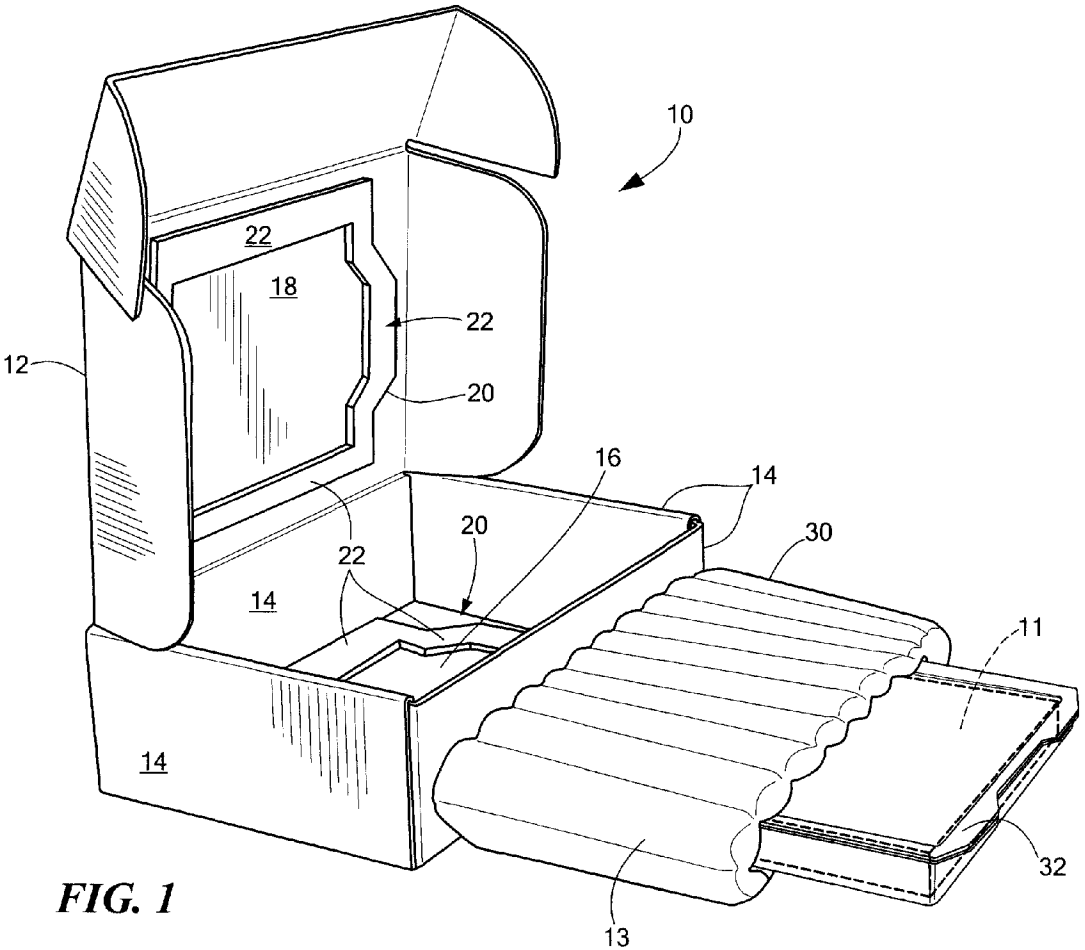
FIG. 1 is an exploded, perspective view of a package for a disk drive according to the disclosure.

Referring now to FIG. 1, a package 10 is shown for a disk drive 11. The package 10 includes: an outer corrugated cardboard carton 12 (here die cut corrugated cardboard shown in a non-folded condition in FIGS. 2A and 2B, and shown in a folded condition in FIGS. 1 and 2C) having: sidewalls 14; a bottom 16 attached to the sidewalls 14; and, a cover 18 pivotally attached to pivot about one of the sidewalls 14 as indicated; a pair of frame members 20, each one having four sidewalls 22 affixed, here by glue, to a corresponding one of the cover 18 and the bottom 16. The frames 20 are each disposed about a receiving region 24 of the frame members 20. It is noted that, as shown more clearly in FIG. 2A, an opposing pair of the sidewalls 22, here the sidewalls labeled 22*a*, 22*b*, are separated a length L1 in the middle section of the receiving region 24 and are separated a different shorter length L2 in the edge section of the region 24. Thus, the region 24 is an elongated, or oval shaped region.

Figure 3:
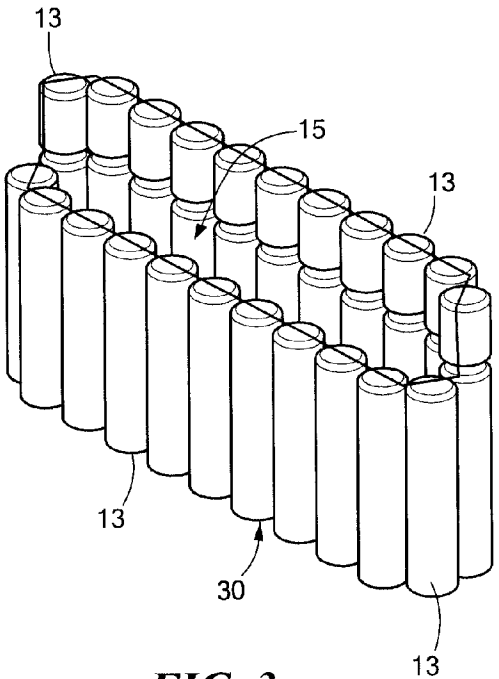
FIG. 3 is a perspective view of an air-filled bubble-like packing device used in the package of FIG. 1.

Referring again to FIG. 1, the package 10 also includes an air-filled bubble-like packing device 30 (shown more clearly in FIG. 3) having check valves (not shown) incorporated therein for providing a plurality of air filled chambers 13, such chambers 13 being arranged to provide a shock absorbing, oval shaped pocket 15. As shown more clearly in FIG. 3, the device 30 the chambers 13 are disposed in an oval to enclose and thus form the oval-shaped pocket 15. It is noted that the chamber are elongated along a direction perpendicular to the elongated direction of the oval-shaped pocket 15.

Figure 6:
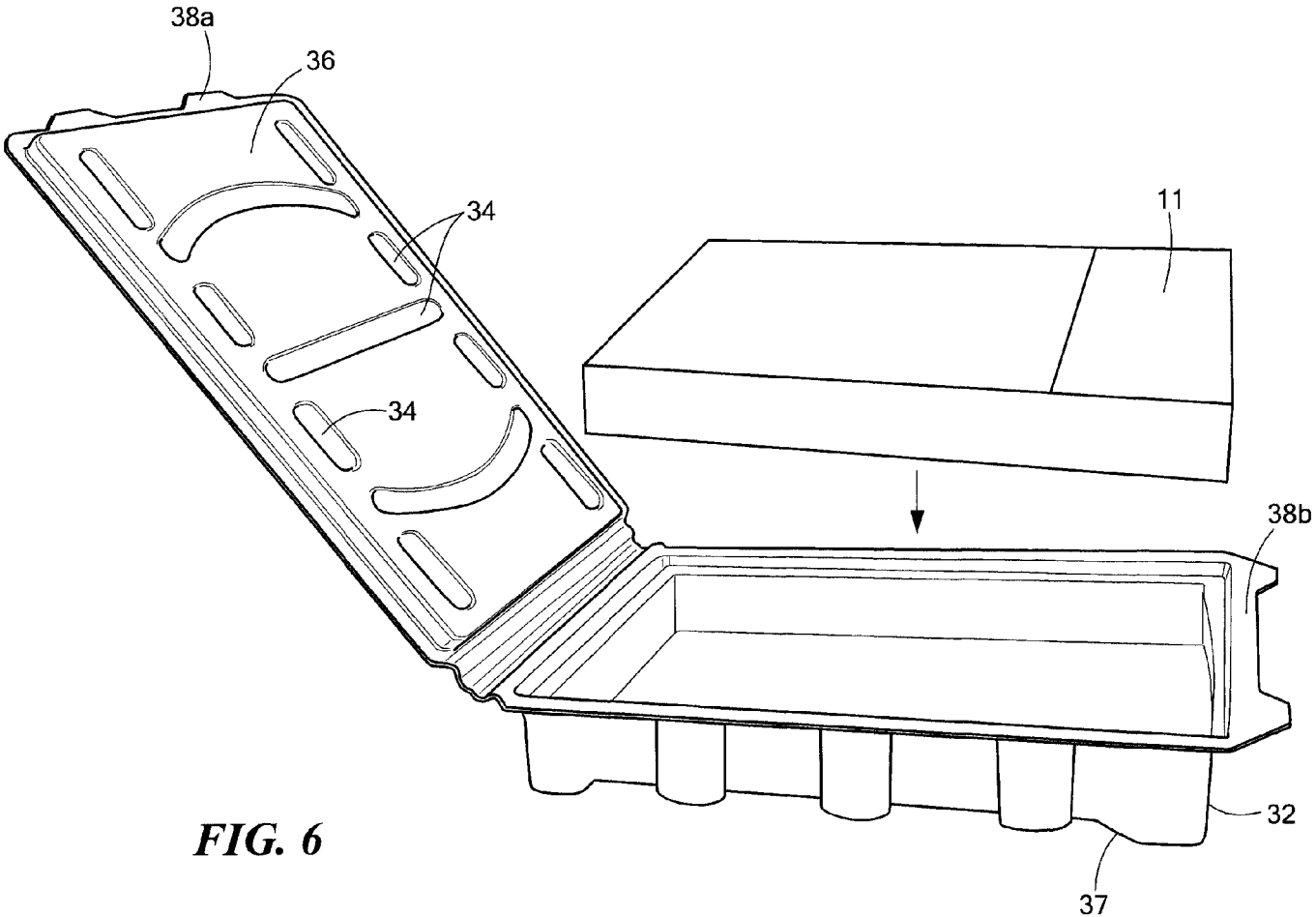
FIG. 6 is a perspective, exploded view of a container for the disk drive and the disk drive adapted for insertion into a pocket formed by the air-filled bubble-like packing device of FIG. 3.

Referring again to FIG. 1, the package 10 also includes a clear plastic clamshell like container 32 (shown more clearly in FIG. 6) for receiving therein the disk drive 11. The plastic container 32 with the disk drive 11 therein are disposed within the oval-shaped pocket 15 of the air-filled bubble-like packing device 30, as indicated in FIG. 1. The top cover 36 of container 32 (FIG. 6) is formed with ridges 34 to confine the disk drive 11 securely within it when the top cover 36 is latched to the bottom 37 by a latching mechanism 38*a*, 38*b* formed in the top cover and bottom 37, respectively. Various views of the storing of the disk drive 11 within the container 32 are shown in FIGS. 4, and 4A-4D.

Figure 5D:
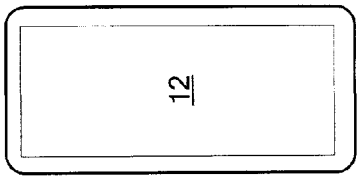
FIG. 5D is an end view of the package of FIG. 1.
Figure 5B:
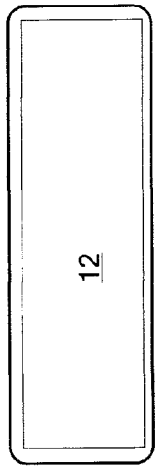
FIG. 5B is a side view of the package of FIG. 1.
Figure 5:
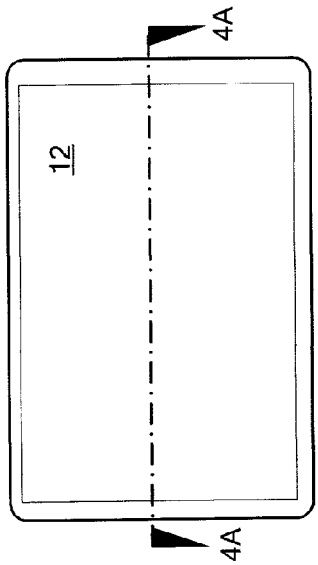
FIG. 5 top view of the package of FIG. 1.
Figure 5A:
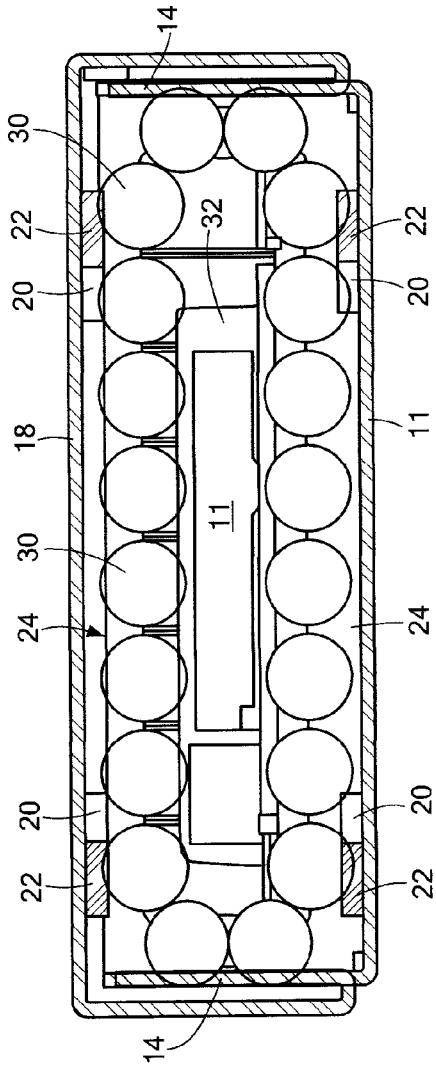
FIG. 5A is a side, cross sectional view taken along line 5A-5A in FIG. 5.
Figure 5C:
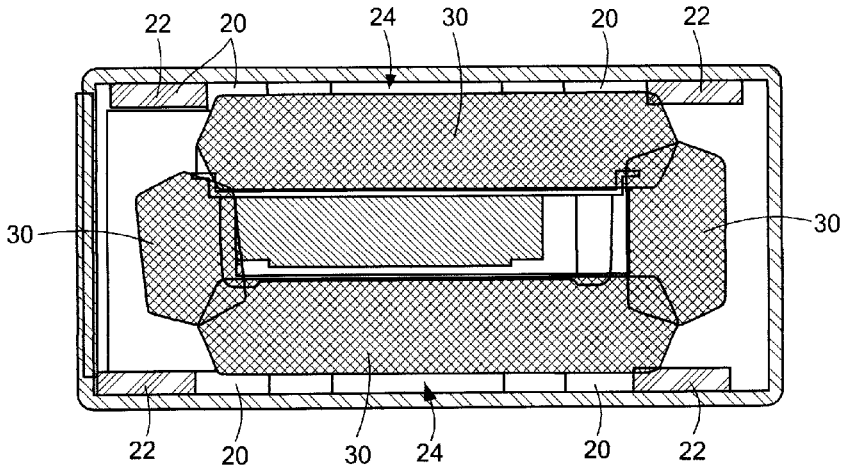
FIG. 5C is a is a side, cross sectional view taken along line 5C-5C in FIG. 5.

Referring now to FIGS. 5, 5A-5D, it is noted that when the air-filled bubble-like packing device 30 with the container 32 therein (and with the disk drive 11 with the container 32), as shown in FIGS. 4, and 4A-4D, are disposed within the carton 12, portions of the air-filled bubble-like packing device 30 are engaged by the frame members 22 and other portions of the device 30 are disposed within the receiving region 24 of the frame after the top 18 is pivoted towards, and then attached to, the one of the sidewalls 22 of the carton 12, as indicated in FIG. 5A. It should be noted that when the air-filled bubble-like packing device 30 with the container 32 therein (and with the disk drive 11 with the container 32), as shown in FIGS. 4, and 4A-4D, are disposed within the carton 12, the elongated axis of the oval-shaped pocket 15 of the device 30 is along the same direction as the elongated axis of the oval-shaped region 24. It is also noted that the air-filled chambers 13 are elongated along a direction perpendicular to the elongated direction of the oval-shaped receiving region 24 and the oval-shaped pocket 15.

Figure 2A:
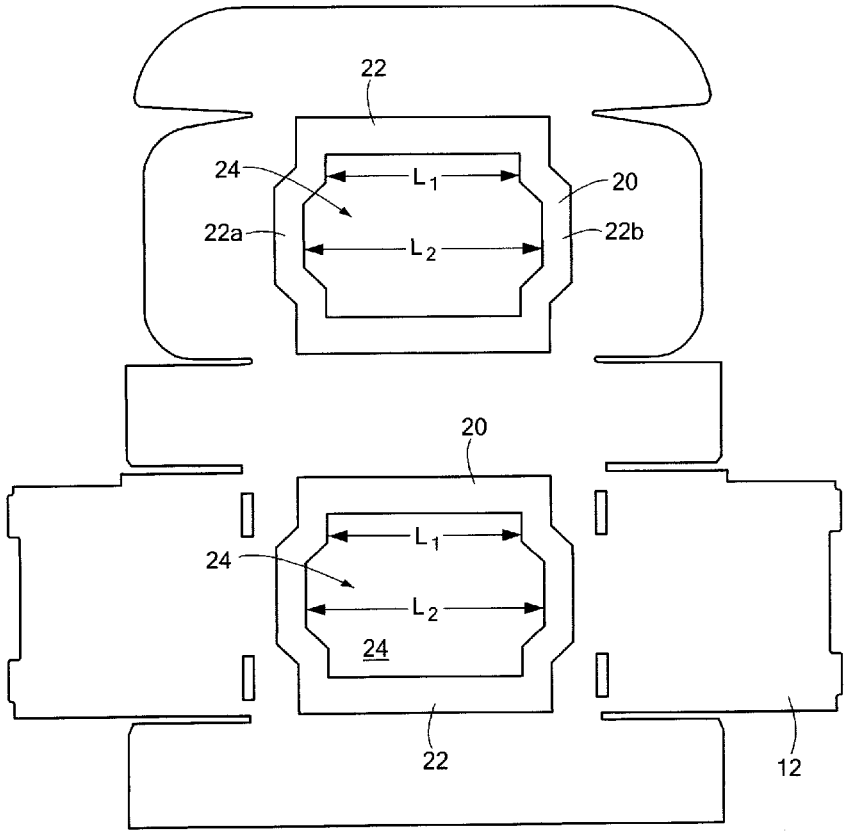
FIGS. 2A and 2B are plan views of the inside and outside, respectively, of a carton used in the package of FIG. 1.
Figure 2B:
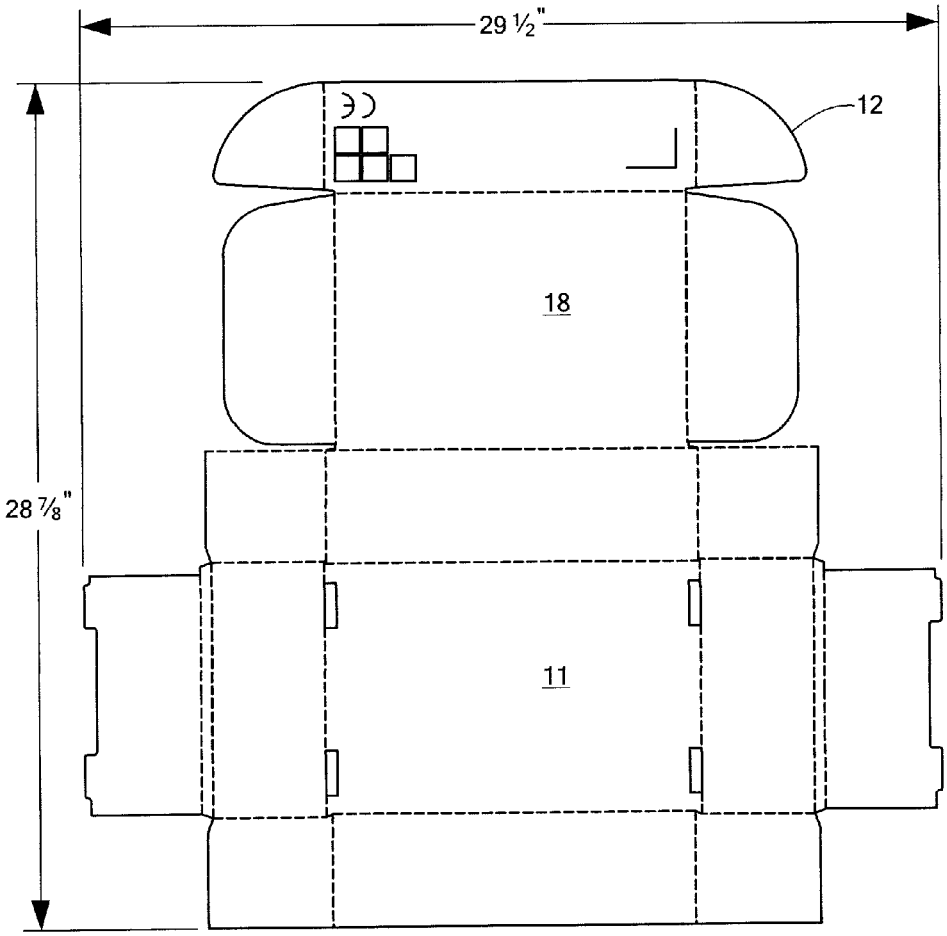
Figure 2C:
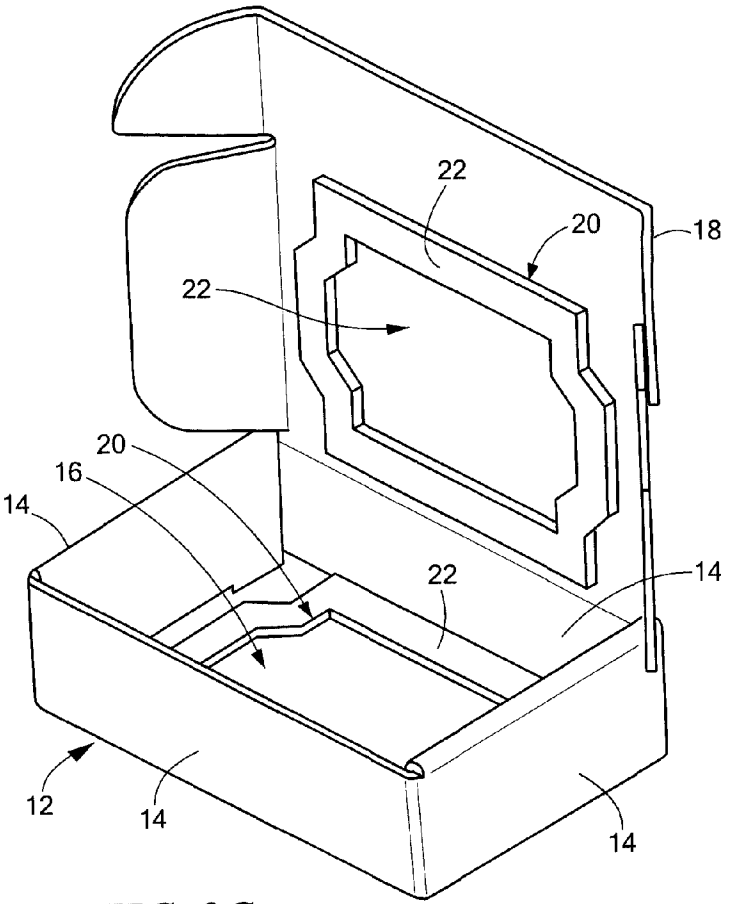
FIG. 2C is a perspective view of the carton of FIGS. 2A and 2B.
Figure 4:
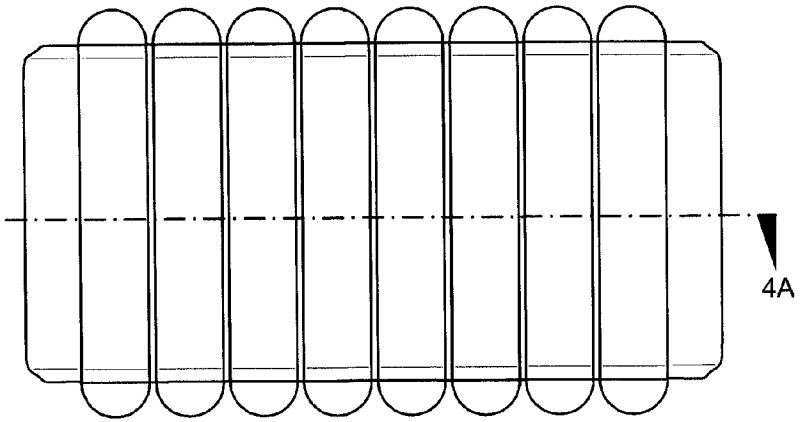
FIG. 4 is a side view of the air-filled bubble-like packing device of FIG. 3 having therein a container for a disk drive and with the disk drive within the container.
Figure 4D:
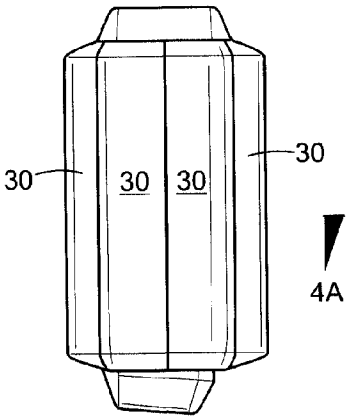
FIG. 4D is an end view of the air-filled bubble-like packing device of FIG. 3 having therein a container for a disk drive and with the disk drive within the container.
Figure 4B:
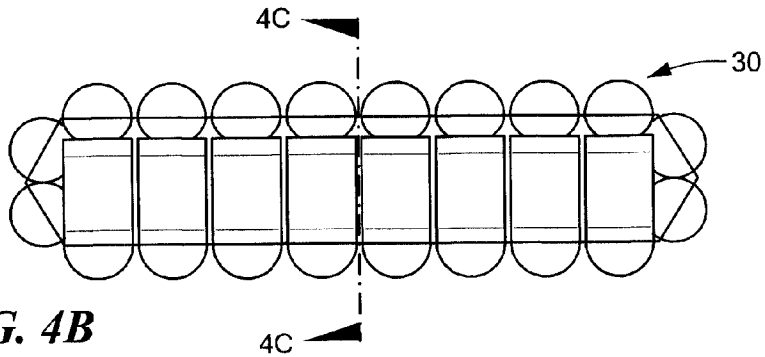
FIG. 4B is a top view of the air-filled bubble-like packing device of FIG. 3 having therein a container for a disk drive and with the disk drive within the container.
Figure 4A:
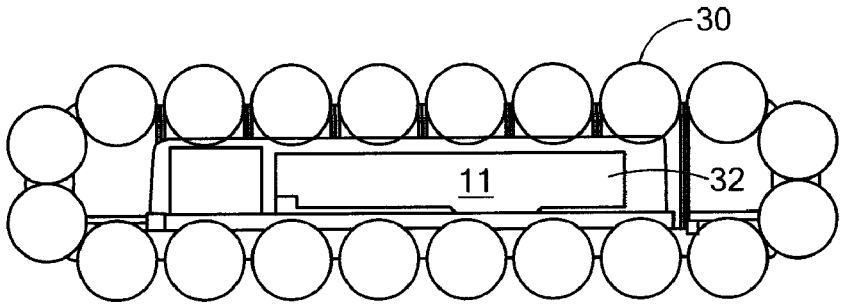
FIG. 4A is a side, cross sectional view taken along line 4A-4A in FIG. 4.
Figure 4C:
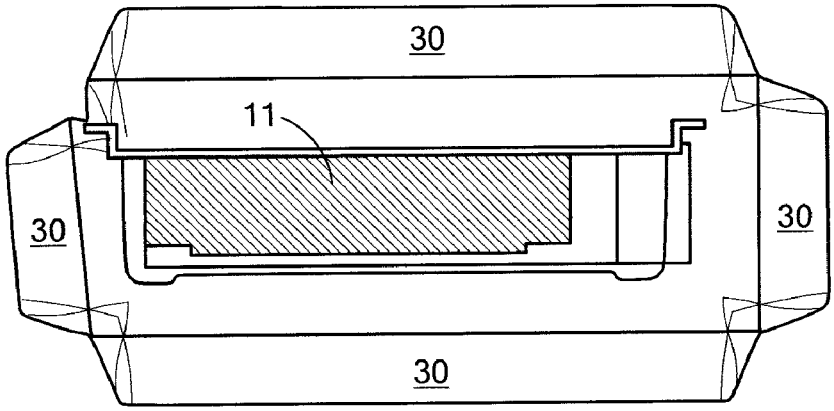
FIG. 4C is a side, cross sectional view taken along line 4C-4C in FIG. 4B.

The corrugated carton 12 (FIGS. 2A and 2B) is here 2001*b*. B Kraft paper dimensioned as indicated in FIGS. 2A and 2B, and an air-filled bubble-like packing device 30 here manufactured by Atlas Box and Crate located in Sutton, Mass. It is noted that the unique shape to the die cuts on the top and bottom of the carton 12 allow easier clearance of the side flaps when they are folded by hand or automated machinery. If a perfect rectangular shape were used, such shape that would interfere with the locking tabs on the sidewall, hence the bevel look to the corners of the die cut.

A number of embodiments of the invention have been described. Nevertheless, it will be understood that various modifications may be made without departing from the spirit and scope of the invention. Accordingly, other embodiments are within the scope of the following claims.

What is claimed is:

1. A package for a disk drive, comprising:

an outer corrugated cardboard carton having: sidewalls; a bottom attached to the sidewalls; and a cover pivotally attached to pivot about one of the sidewalls;

a pair of frame members, each one having four sidewalls affixed to a corresponding one of the cover and the bottom disposed about a receiving region of the frame members;

an air-filled bubble-like packing device having a plurality of air-filled chambers, such chambers being arranged to provide a shock absorbing pocket;

a container for receiving therein the disk drive;

wherein the container with the disk drive therein are disposed within the pocket of the air-filled bubble-like packing device; and wherein the air-filled bubble-like packing device with the container and disk drive therein are disposed within the carton with portions of the air-filled bubble-like packing device being engaged by the frame members and other portions being disposed within a receiving region after the top is pivoted towards, and then attached to, one of the sidewalls of the carton.

2. The package recited in claim 1 wherein at least one of the receiving regions is oval-shaped and the pocket is oval-shaped.

3. The package recited in claim 2 wherein the oval-shaped receiving region and the oval-shaped pocket are both elongated along the same direction.

4. The package recited in claim 3 wherein the chambers are elongated along a direction perpendicular to the elongated direction of the oval-shaped receiving region and the oval-shaped pocket.

* * * * *